US006851146B1

(12) United States Patent
Kristof et al.

(10) Patent No.: US 6,851,146 B1
(45) Date of Patent: Feb. 8, 2005

(54) NECK PILLOW SYSTEM

(76) Inventors: Ronald J. Kristof, 164 Keel Ridge Dr., Georgetown, KY (US) 40324; Beverly A. Kristoff, 164 Keel Ridge Dr., Georgetown, KY (US) 40324

( * ) Notice: Subject to any disclaimer, the term of this patent is extended or adjusted under 35 U.S.C. 154(b) by 0 days.

(21) Appl. No.: 10/662,211

(22) Filed: Sep. 12, 2003

(51) Int. Cl.[7] ..... A47C 20/02
(52) U.S. Cl. ..... 5/636; 5/637; 5/915
(58) Field of Search ..... 5/636, 637, 915; 4/519, 523; 601/46, 50, 51, 97, 56–60, 98, 99, 101–103, 112, 113, 93, 94

(56) References Cited

U.S. PATENT DOCUMENTS 4,763,364 A * 8/1988 Morgan ..... 4/523
4,881,529 A * 11/1989 Santos ..... 2/468
4,949,407 A * 8/1990 Singer et al. ..... 4/523
4,998,303 A * 3/1991 Smithers ..... 4/523
5,079,777 A * 1/1992 Fowler et al. ..... 2/50
5,393,297 A * 2/1995 Kristoff ..... 601/57

* cited by examiner

*Primary Examiner*—Teri Pham Luu
(74) *Attorney, Agent, or Firm*—Edward P. Dutkiewicz

(57) ABSTRACT

A pillow has a curved central extent and a downwardly extending leg. The leg is positionable in a vertical plane. A rotatable eccentric is in a generally semi-circular configuration and has a periphery. A plurality of balls is secured to the periphery of the eccentric for rotation with the periphery. A motor has a driven shaft. The drive shaft has a lower end and an upper end. The lower end is supported by the motor. The upper end has a bushing supporting the upper end of the shaft. A motor enclosure is coupled to the leg beneath the pillow with a waterproof connection to the motor.

4 Claims, 3 Drawing Sheets

FIG. 3
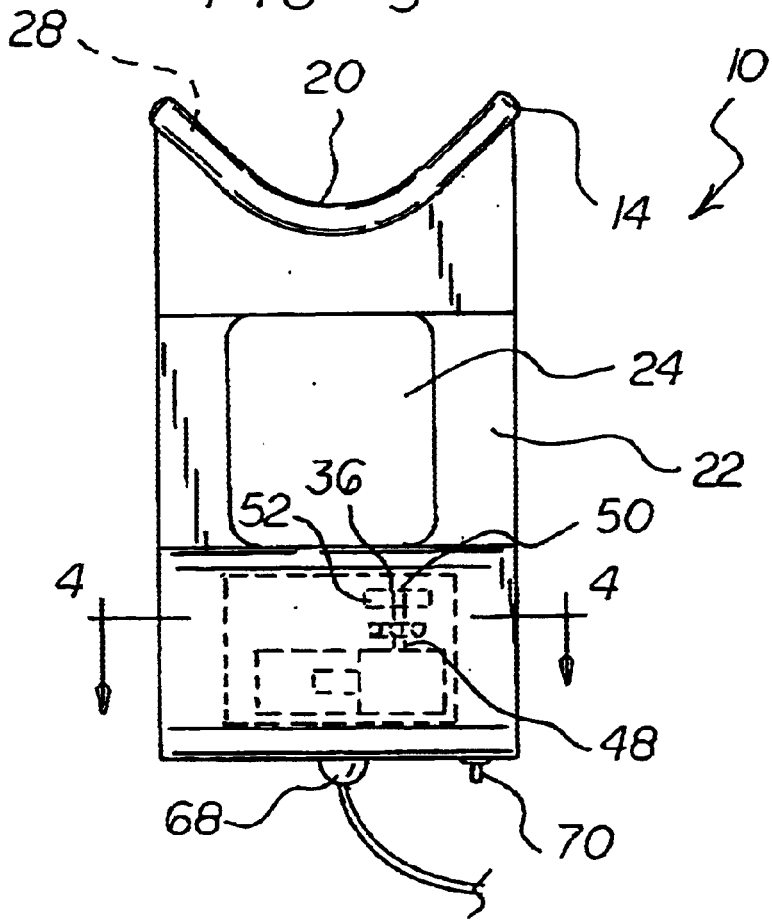
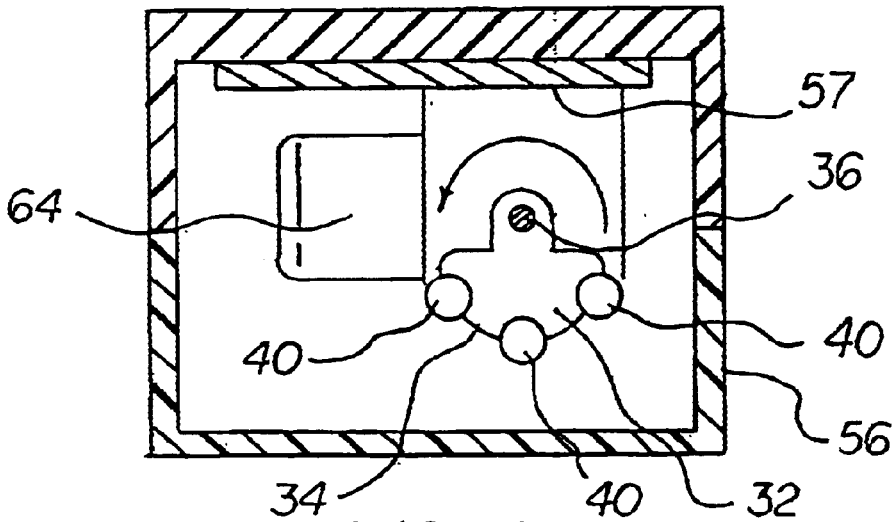
FIG 4

NECK PILLOW SYSTEM

BACKGROUND OF THE INVENTION

1. Field of the Invention

The present invention relates to a neck pillow system and more particularly pertains to generating internal vibration in a safe and relaxing manner while shampooing a patron's hair.

2. Description of the Prior Art

The use of neck supports of known designs and configurations is known in the prior art. More specifically, neck supports of known designs and configurations previously devised and utilized for the purpose of supporting necks through known methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,763,364 to Morgan a shampoo bowl neck cushioning device. U.S. Pat. No. 4,881,529 to Santos discloses a neck support collar. U.S. Pat. No. 4,949,407 to Singer discloses a shampoo basin neck rest. U.S. Pat. No. 4,998,303 to Smithers discloses a head support for salon basin. U.S. Pat. No. 5,079,777 to Fowler discloses a top cover accessory to be worn about the neck during hair dressing. Lastly, U.S. Pat. No. 5,393,297 to Kristoff discloses neck pillows with internal vibrational mechanisms.

While these devices fulfill their respective, particular objectives and requirements, the aforementioned patents do not describe a neck pillow system that allows generating internal vibration in a safe and relaxing manner while shampooing a patron's hair.

In this respect, the neck pillow system according to the present invention substantially departs from the conventional concepts and designs of the prior art, and in doing so provides an apparatus primarily developed for the purpose of generating internal vibration in a safe and relaxing manner while shampooing a patron's hair.

Therefore, it can be appreciated that there exists a continuing need for a new and improved neck pillow system which can be used for generating internal vibration in a safe and relaxing manner while shampooing a patron's hair. In this regard, the present invention substantially fulfills this need.

SUMMARY OF THE INVENTION

In view of the foregoing disadvantages inherent in the known types of neck supports of known designs and configurations now present in the prior art, the present invention provides an improved neck pillow system. As such, the general purpose of the present invention, which will be described subsequently in greater detail, is to provide a new and improved neck pillow system and method which has all the advantages of the prior art and none of the disadvantages.

To attain this, the present invention essentially comprises a pillow. The pillow is positionable over a curved indentation. The indentation is at the edge of a shampooing sink. The pillow has a curved central extent. The curved central extent is shaped to conform with the indentation of the sink. The pillow has a downwardly extending leg. The leg is positionable in a vertical plane exteriorly of the sink. The leg has a large rectangular aperture. The aperture is provided for weight reduction purposes. The leg and pillow are fabricated of an external waterproof material. The waterproof material is configured to seal the interior of the leg and pillow.

A layer of elastomeric foam is provided. The foam is provided in the curved central extent of the interior of the pillow.

Provided next is a rotatable eccentric. The eccentric is provided in a generally semi-circular configuration. The eccentric has a periphery and a vertical axis of rotation.

Next provided is a plurality of balls. The balls are secured to the periphery of the eccentric for rotation with the periphery.

A motor is provided next. The motor has a driven shaft. The shaft is rotatable in the axis of rotation. The shaft has a lower end. The lower end is supported by the motor. The shaft has an upper end. The upper end has a bushing. The bushing supports the upper end of the shaft to extend the life of the motor.

Also provided is a motor enclosure. The motor enclosure is coupled to the leg beneath the pillow. The motor enclosure is fabricated of plastic. The motor enclosure has an electrical cord. A waterproof connection is provided to the motor. The enclosure and its contents are enclosed within a waterproof material.

Further provided is an electrical circuit. The electrical circuit powers the motor. A ground fault interruption is provided. The ground fault interruption protects a user and patron from electrical shocks during operation and shampooing use while a patron's neck is on the pillow. All of the components of the system are waterproof.

Provided last is a switch. The switch is provided on the exterior surface of the enclosure. The switch provides for activating and inactivating the motor. A control knob is provided on the vibrational unit. The control knob adjusts the intensity of the desired vibration.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved neck pillow system which has all of the advantages of the prior art neck supports of known designs and configurations and none of the disadvantages.

It is another object of the present invention to provide a new and improved neck pillow system which may be easily and efficiently manufactured and marketed.

It is further an object of the present invention to provide a new and improved neck pillow system which is of durable and reliable constructions.

An even further object of the present invention is to provide a new and improved neck pillow system which is susceptible of a low cost of manufacture with regard to both materials and labor, and which accordingly is then susceptible of low prices of sale to the consuming public, thereby making such neck pillow system economically available to the buying public.

Even still another object of the present invention is to provide a neck pillow system for generating internal vibration in a safe and relaxing manner while shampooing a patron's hair.

Lastly, it is an object of the present invention to provide a new and improved neck pillow system. A pillow has a curved central extent and a downwardly extending leg. The leg is positionable in a vertical plane. A rotatable eccentric is in a generally semi-circular configuration and has a periphery. A plurality of balls is secured to the periphery of the eccentric for rotation with the periphery. A motor has a driven shaft. The drive shaft has a lower end and an upper end. The lower end is supported by the motor. The upper end has a bushing supporting the upper end of the shaft. A motor enclosure is coupled to the leg beneath the pillow with a waterproof connection to the motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear elevational view of the pillow system shown in FIGS. 1 and 2, taken along line 3—3 of FIG. 2.

FIG. 4 is an enlarged sectional view of the pillow system taken along line 4—4 of FIG. 3.

The same reference numerals refer to the same parts throughout the various Figures.

DESCRIPTION OF THE PREFERRED EMBODIMENT

Figure 1:
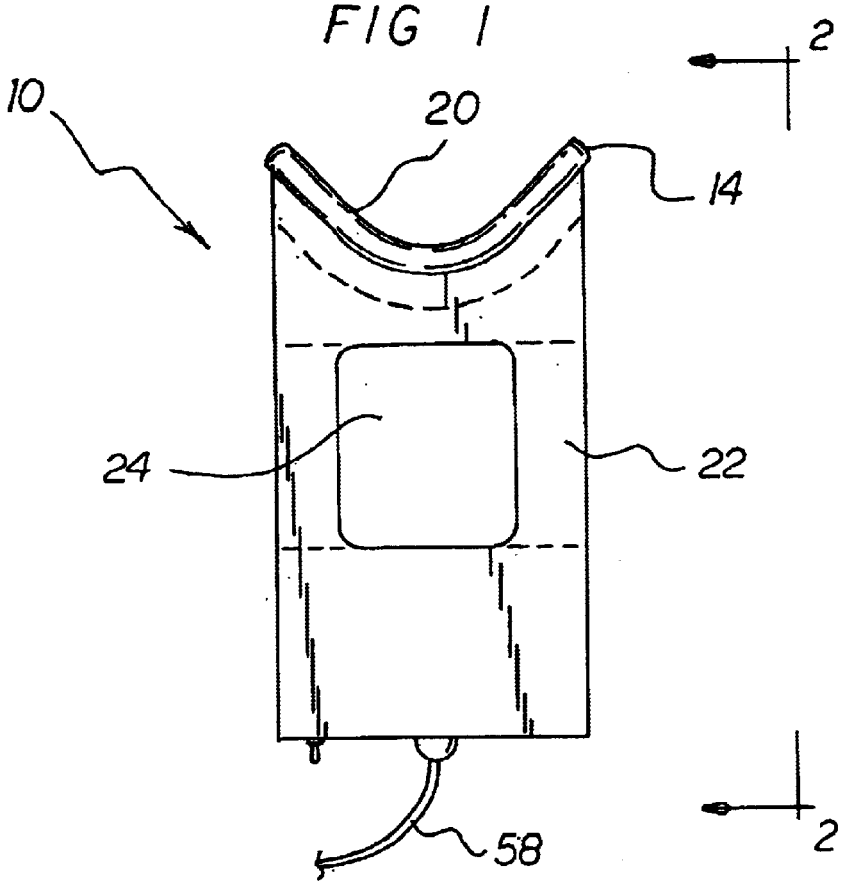
FIG. 1 is a front elevational view of the preferred embodiment of the new and improved neck pillow system for generating internal vibrations in a safe and relaxing manner while shampooing a patron's hair constructed in accordance with the principles of the present invention.
Figure 2:
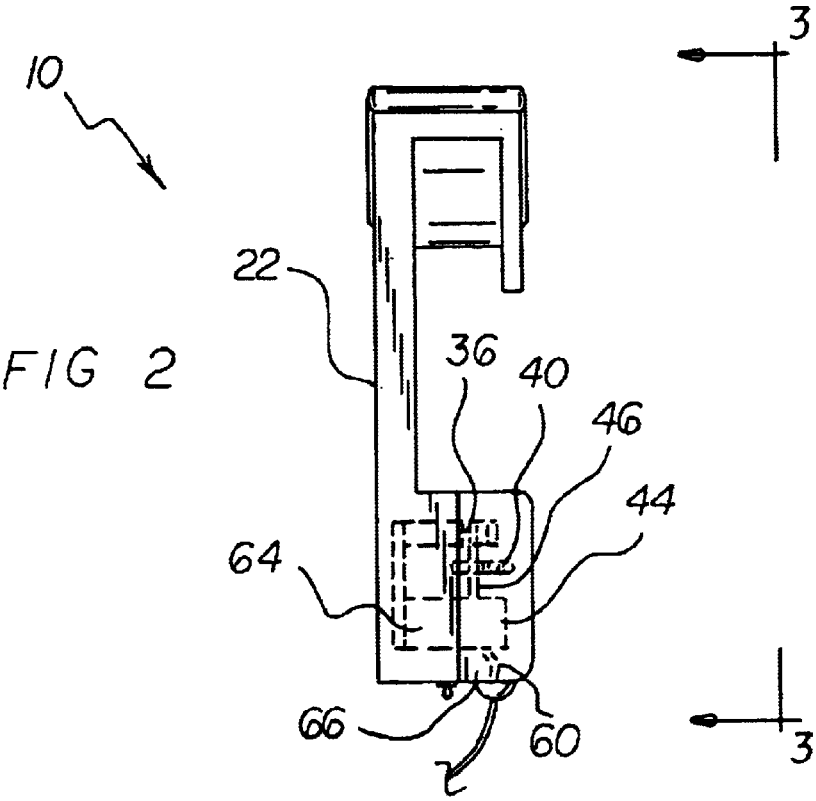
FIG. 2 is a side elevational view of the pillow system shown in FIG. 1, taken along line 2—2 of FIG. 1.
Figure 5:
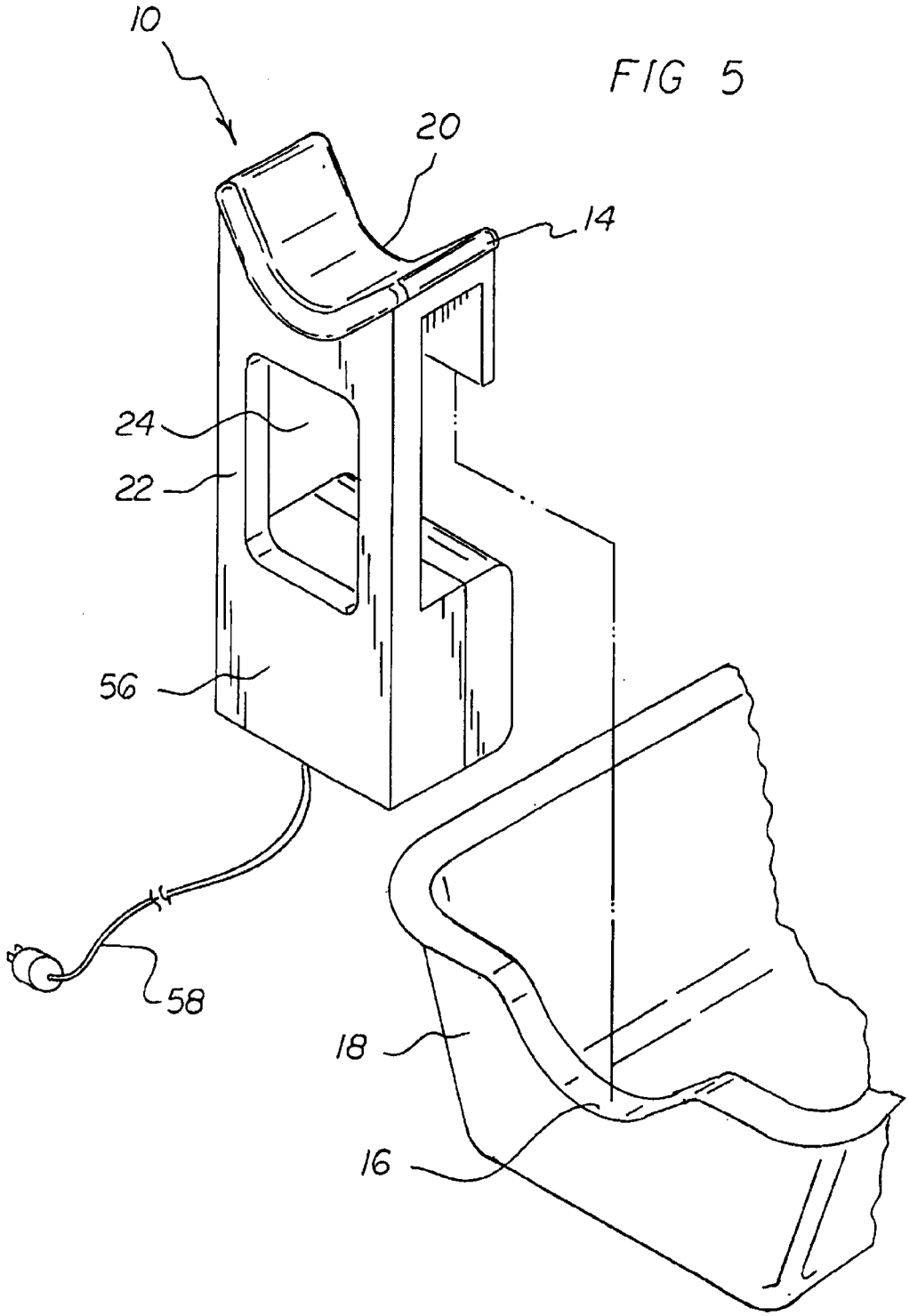
FIG. 5 is an exploded perspective illustration of the pillow system shown in FIGS. 1 through 4.

With reference now to the drawings, and in particular to FIG. 1 thereof, the preferred embodiment of the new and improved neck pillow system embodying the principles and concepts of the present invention and generally designated by the reference numeral 10 will be described.

The present invention, the neck pillow system 10 is comprised of a plurality of components. Such components in their broadest context include a pillow, a rotatable eccentric, a plurality of ball, and a motor. Such components are individually configured and correlated with respect to each other so as to attain the desired objective.

First provided is a pillow 14. The pillow is positionable over a curved indentation 16. The indentation is at the edge of a shampooing sink 18. The pillow has a curved central extent 20. The curved central extent is shaped to conform with the indentation of the sink. The pillow has a downwardly extending leg 22. The leg is positionable in a vertical plane exteriorly of the sink. The leg has a large rectangular aperture 24. The aperture is provided for weight reduction purposes. The leg and pillow are fabricated of an external waterproof material. The waterproof material is configured to seal the interior of the leg and pillow.

A layer 28 of elastomeric foam is provided. The foam is provided in the curved central extent of the interior of the pillow.

Provided next is a rotatable eccentric 32. The eccentric is provided in a generally semi-circular configuration. The eccentric has a periphery 34 and a vertical axis of rotation 36.

Next provided is a plurality of balls 40. The balls are secured to the periphery of the eccentric for rotation with the periphery.

A motor 44 is provided next. The motor has a driven shaft 46. The shaft is rotatable in the axis of rotation. The shaft has a lower end 48. The lower end is supported by the motor. The shaft has an upper end 50. The upper end has a bushing 52. The bushing supports the upper end of the shaft to extend the life of the motor.

Also provided is a motor enclosure including a strike plate 57. Upon rotation of the eccentric 32, the balls 40 contact the strike plate 57, setting up a harmonic vibration. The motor enclosure is coupled to the leg beneath the pillow. The motor enclosure is fabricated of plastic. The motor enclosure has an electrical cord 58. A waterproof connection 60 is provided to the motor. The enclosure and its contents are enclosed within a waterproof material.

Further provided is an electrical circuit 64. The electrical circuit powers the motor. A ground fault interruption 66 is provided. The ground fault interruption protects a user and patron from electrical shocks during operation and shampooing use while a patron's neck is on the pillow. All of the components of the system are waterproof.

Provided last is a switch 68. The switch is provided on the exterior surface of the enclosure. The switch provides for activating and inactivating the motor. A control knob 70 is provided on the vibrational unit. The control knob adjusts the intensity of the desired vibration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A neck pillow system for generating internal vibrations in a safe and relaxing manner while shampooing a patron's hair comprising, in combination:

a pillow positionable over a curved indentation at the edge of a shampooing sink, the pillow having a curved central extent shaped to conform with the indentation of the sink and a downwardly extending leg positionable in a vertical plane exteriorly of the sink, the leg having a large rectangular aperture for weight reduction purposes, the leg and pillow being fabricated of an external waterproof material configured to seal the interior of the leg and pillow;

a layer of elastomeric foam interior of the pillow in the curved central extent thereof;

a rotatable eccentric in a generally semi-circular configuration with a periphery and a vertical axis of rotation;

a plurality of balls secured to the periphery of the eccentric for rotation there with;

a motor with a driven shaft rotatable in the axis of rotation, the shaft having a lower end supported by the motor, the shaft having an upper end with a bushing supporting the upper end of the shaft to extend the life of the motor;

a motor enclosure coupled to the leg beneath the pillow and fabricated of plastic with an electrical cord and a waterproof connection to the motor, the enclosure and its contents being enclosed within a waterproof material;

an electrical circuit for powering the motor with a ground fault interruption to protect a user and patron from electrical shocks during operation and shampooing use while a patron's neck is on the pillow, all of the components of the system being waterproof; and a switch on the exterior surface of the enclosure for activating and inactivating the motor and a control knob on the vibrational unit which will adjust the intensity of the desired vibration.

2. A neck pillow system comprising:

a pillow having a curved central extent and a downwardly extending leg positionable in a vertical plane;

a rotatable eccentric in a generally semi-circular configuration with a periphery;

a plurality of balls secured to the periphery of the eccentric for rotation there with;

a motor with a driven shaft having a lower end supported by the motor and an upper end with a bushing supporting the upper end of the shaft; and a motor enclosure coupled to the leg beneath the pillow with a waterproof connection to the motor.

3. The system as set forth in claim 2 and further including an electrical circuit for powering the motor, all of the components of the system being waterproof.

4. The system as set forth in claim 3 and further including a switch on the exterior surface of the enclosure for activating and inactivating the motor and a control knob on the vibrational unit which will adjust the intensity of the desired vibration.

* * * * *